US006344007B1

(12) United States Patent
Feeney et al.

(10) Patent No.: US 6,344,007 B1
(45) Date of Patent: Feb. 5, 2002

(54) BAT WITH HIGH MOMENT OF INERTIA TO WEIGHT RATIO AND METHOD OF FABRICATION

(75) Inventors: Brain P. Feeney, Enfield, CT (US); Thomas J. Kennedy, III, Wilbraham; Ronald P. LaLiberty, Dudley, both of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/311,513

(22) Filed: May 13, 1999

Related U.S. Application Data

(63) Continuation-in-part of application No. 08/911,337, filed on Aug. 14, 1997, now abandoned, which is a continuation-in-part of application No. 08/669,072, filed on Jun. 24, 1996, now abandoned, which is a continuation-in-part of application No. 08/595,535, filed on Feb. 2, 1996, now Pat. No. 5,722,908.

(51) Int. Cl.[7] ..... A63B 59/06
(52) U.S. Cl. ..... 473/567; 473/566
(58) Field of Search ..... 473/566, 567, 473/457, FOR 169, FOR 170

(56) References Cited

U.S. PATENT DOCUMENTS

| | | | | |
|---|---|---|---|---|
| 3,729,146 A | | 4/1973 | Heald, Jr. | |
| 3,841,130 A | | 10/1974 | Scott, Jr. et al. | |
| 3,854,316 A | | 12/1974 | Wilson | |
| 4,569,521 A | | 2/1986 | Mueller | |
| 4,848,745 A | * | 7/1989 | Bohannan et al. | 473/567 |
| 5,722,908 A | * | 3/1998 | Feeney et al. | 473/567 |
| 6,042,493 A | * | 5/2000 | Chauvin et al. | 473/567 |
| 6,056,655 A | * | 5/2000 | Feeney et al. | 473/567 |

FOREIGN PATENT DOCUMENTS

| | | |
|---|---|---|
| JP | 4-271120 | 5/1994 |

OTHER PUBLICATIONS

ASTM Standards for COR Sep. 12, 1995.

* cited by examiner

*Primary Examiner*—Mark S. Graham

(57) ABSTRACT

The present invention relates to a bat with improved playing characteristics. Although the present invention will be described generally, the present invention can be employed with softball, baseball and other types of game bats. Specifically, the present invention relates to a bat with a moment of inertia to weight ratio that is higher then conventional bats. This improved ratio is achieved by producing a bat that is lighter than conventional bats without altering the bat's moment of inertia. The higher ratio of the present invention allows for faster swing speeds with no loss in power. These improved playing characteristics can be achieved in either an aluminum or a composite bat.

7 Claims, 5 Drawing Sheets

BAT WITH HIGH MOMENT OF INERTIA TO WEIGHT RATIO AND METHOD OF FABRICATION

RELATED APPLICATIONS

This application is a continuation-in-part of U.S. patent application Ser. No. 08/911,337 filed Aug. 14, 1997, abandoned, which is a continuation-in-part of U.S. patent application Ser. No. 08/669,072 filed Jun. 24, 1996, abandoned, which is a continuation-in-part of U.S. Pat. Ser. No. 08/595,535 filed Feb. 2, 1996, U.S. Pat. No. 5,722,908 the subject matter of which applications are included by reference herein.

BACKGROUND OF THE INVENTION

1. Field of the Invention

The present invention relates to a bat and its method of fabrication and more particularly pertains increasing the moment of inertia to weight ratio of bats for improved playing characteristics.

2. Description of the Prior Art

There are several techniques in the prior art for the construction of bats. Prior art bats have typically been constructed from wood, metal or a composite-type material. All such bats have a hitting region, a handle region, and a transition area intermediate the hitting and handle regions. Typically, the hitting area has an outer diameter which is substantially larger than either the handle or transition areas. Additionally, bats constructed from metal are typically formed with a hollow interior. Most metal bats are constructed by way of a swaging and/or drawing process. Such a process starts with a metal cylinder of a uniform diameter. The handle and transition areas are then worked until the appropriate diameters are achieved. The bats described herein can be made in accordance with co-pending application Ser. Nos. 08/669,072 or 08/595,535. Both of the above described manufacturing techniques have typically produced bats with moment of inertia (MOI) to weight ratios of between 290 to 340 oz-in$^2$ for slow pitch softball bats, less for fast pitch softball bats when the MOI is measured about a reference point six inches from the end of the handle portion of the bat as described in the Standard Test Method for Measuring Bat Performance Factors, Revision 6.1 Proposed ASTM Method by Dr.

Brandt of NYU.

Typical bat constructions are illustrated in the following U.S. Patents. For example, U.S. Pat. No. 5,421,572 to MacKay, Jr. discloses a full barrel aluminum baseball bat and end cap construction. U.S. Pat. No. 5,393,055 to MacKay, Jr. discloses a ball bat with a concentrated weight load. U.S. Pat. No. 5,180,163 to Lanctot et al discloses a baseball bat with a tubular member positioned in the interior of the bat at substantially the handle portion. U.S. Pat. No. 5,094,453 to Douglas discloses a ball bat with an inward off-set center of gravity. U.S. Pat. Nos. 4,746,117 and 4,834,370 to Noble each disclose a tubular bat with an optimized power zone. U.S. Pat. No. 4,331,330 to Worst discloses a baseball bat with an improved hitting surface and less mass. U.S. Pat. No. 3,854,316 to Wilson discloses a method of making a hollow metal bat with a uniform wall thickness. U.S. Pat. No. 3,841,130 to Scott, Jr. et al. discloses a ball bat system utilizing a hollow metal body and a swaging process. U.S. Pat. No. 3,729,196 to Heald, Jr. discloses a metal bat having a hollow metal casing formed from a tube. Lastly, foreign patent Japanese application Serial Number 4-271120 published Sep. 14, 1992 to Higuchi and assigned to Mizuno Corporation discloses a bat and forming method therefor.

As illustrated by the great number of patents as well as commercial game bats, efforts are continuously being made in an attempt to improve the playing characteristics of such bats. Such efforts are made to render bats of ever increasing capabilities during play. None of these previous efforts, however, provides the benefits attendant with the present invention. Additionally, the prior patents and commercial devices do not suggest the present inventive combination of methods steps and component elements arranged and configured as disclosed and claimed herein. The present invention achieves its intended purposes, objects and advantages through a new, useful and unobvious combination of method steps and component elements, with the use of a minimum number of functioning parts, at a reasonable cost to manufacture and by employing only readily available materials.

Specifically, the object of the present invention is to provide a bat with an increased moment of inertia to weight ratio. This improved ratio is achieved by producing a bat that is lighter than conventional bats without altering the bat's moment of inertia. The improved ratio, and corresponding improved playing characteristics, can be achieved using many materials including aluminum, aluminum/composite, all composite, or other materials.

It is another object of the present invention to provide a lighter bat that allows for faster swing speeds and increased amounts of power delivered to the ball at impact.

It is a further object of the present invention to provide improved manufacturing techniques for the construction of bats.

An even further object of the present invention is to provide bats which are susceptible of a low cost of manufacture with regard to both materials and labor, and which accordingly are then susceptible of low prices of sale to the consuming public, thereby making such bats economically available to the buying public.

In this respect, the game bat according to the present invention substantially departs from the conventional concepts and designs of the prior art, and in doing so provides an apparatus primarily developed for the purpose of increasing playing characteristics.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the attached claims with the specific embodiments shown in the attached drawings. For the purposes of summarizing the present invention, the present invention essentially comprises a softball bat including a handle end having an opened first end, a second end and an intermediate extent therebetween. A knob is positioned over the first end of the handle to enable a player to swing the bat. A hitting portion is also included which is defined by a first end, an opened second end and an intermediate extent therebetween. An end cap is fitted into the opened second end of the hitting portion. The bat also includes a transition zone which has a first end continuous with the second end of the handle end and a second end continuous with the first end of the hitting portion. The handle end, hitting portion and transition zone are each constructed from aluminum. Furthermore, the handle, transition zone and hitting portion are each defined by a generally uniform wall thickness throughout. The wall thickness is selected such that an overall mass moment of inertia to weight ratio greater than 350 oz-in$^2$ and a weight less than 28.5 ounces can be produced. Also included is the method of fabricating such bat.

The foregoing has outlined rather broadly the more pertinent and important features of the present invention. The detailed description of the invention that follows is offered so that the present contribution to the art may be more fully appreciated. Additional features of the invention will be described hereinafter. These form the subject of the claims of the invention.

It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

The same reference numerals refer to the same parts through the various Figures.

DESCRIPTION OF THE PREFERRED EMBODIMENT

Figure 1:
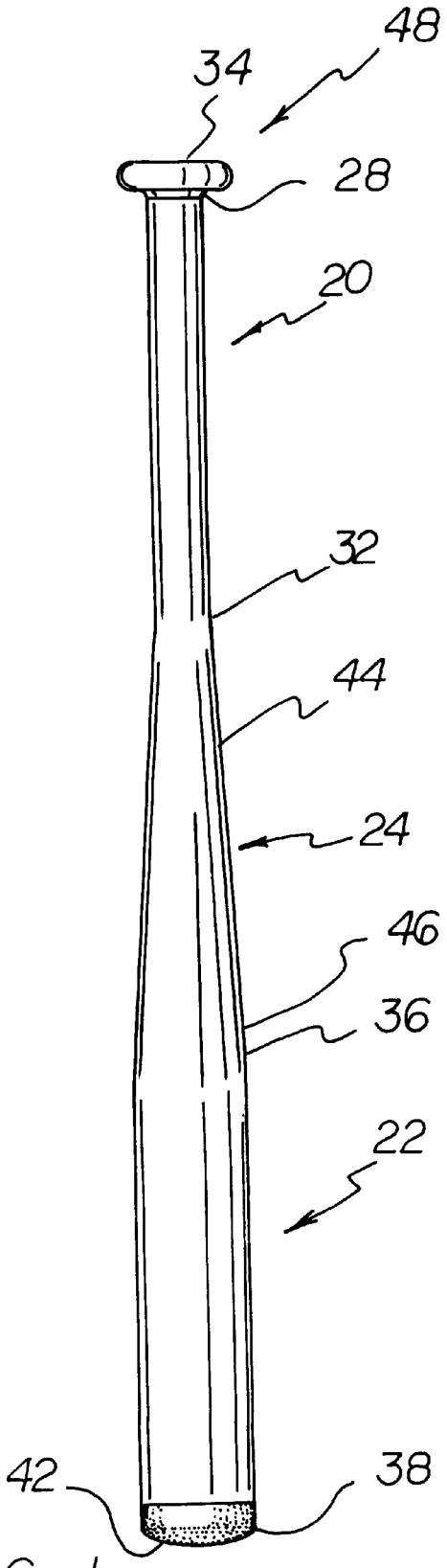
FIG. 1 is an elevational view of the aluminum bat constructed in accordance with the principles of the present invention.
Figure 2:
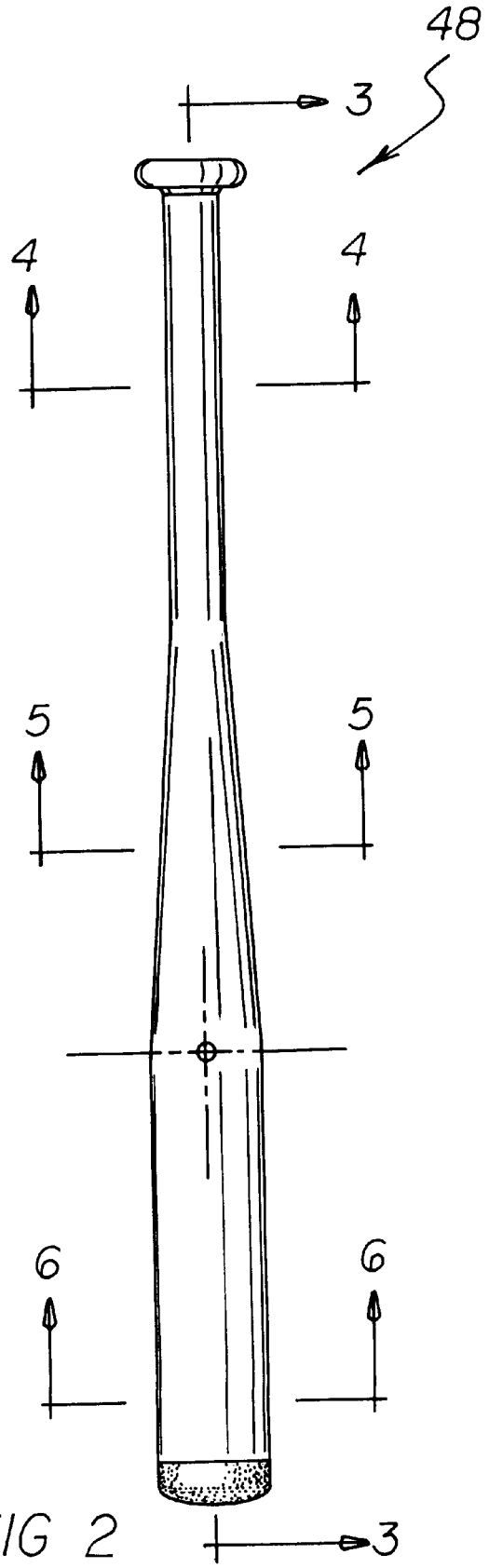
FIG. 2 is an elevational view of the bat constructed in accordance with the principles of the present invention.

With reference now to the drawings, and in particular to FIG. 1 thereof, the preferred embodiment of the new and improved bat with enhanced playing characteristics embodying the principles and concepts of the present invention will next be described.

The present invention will be described in conjunction with game bats generally. The present invention, however, finds particular application in conjunction with softball and baseball bats. Specifically, the present invention relates to a bat with a moment of inertia to weight ratio that is higher than conventional bats. This improved ratio is achieved by producing a lighter bat without altering the moment of inertia. The higher ratio of the present invention allows for faster swing speeds with no loss in power. This, in turn, means more energy is available at impact to transfer to the ball.

One possible version of the current invention would consist of a handle end, transition zone, and hitting end that are each constructed of aluminum. In this all-aluminum version, the handle area and transition areas would be thinner and therefore lighter than traditional all-aluminum bats. A second version of the invention would utilize a composite and aluminum construction. This construction incorporates a lightweight composite handle and transition areas joined with an aluminum hitting area.

In both versions the result is an unfinished bat, often referred to as a shell, that would be significantly lighter than a traditional unfinished bat. By addition of a handle knob, grip, end cap, and end loading this lighter weight shell can be finished such that it produces a bat with a mass moment of inertia to weight ratio that is greater than 350 oz-in$^2$ and a weight less than 28.5 ounces. The various details of the present invention will be described in greater detail hereinafter.

The bat of the present invention includes a handle end 20, a hitting portion 22, a transition zone 24, as well as a hollow interior. Furthermore, the handle end 20 is defined by an opened first end 28, a second end 32 and an intermediate extent therebetween. In order to facilitate a player's grip upon the handle 20 a handle knob 34 is secured to the first end of the handle 20. Such a handle knob 34 can be welded, or otherwise secured, to the handle 20 in a manner known in the prior art. In a similar fashion, the hitting portion 22 is defined by a first end 36, an opened second end 38 and an intermediate extent therebetween. Furthermore, to enclose the interior of the bat an end cap 42 is fitted into, or otherwise secured, to the opened second end 38 of the hitting portion 22. This end cap, in the preferred embodiment, is formed from a cast-in-place elastomer such as urethane.

Figure 3A:
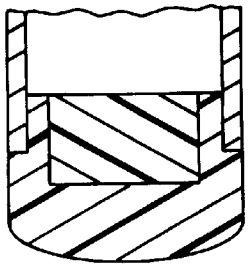
FIG. 3A is an alternate embodiment for the end cap of the bat.
Figure 3:
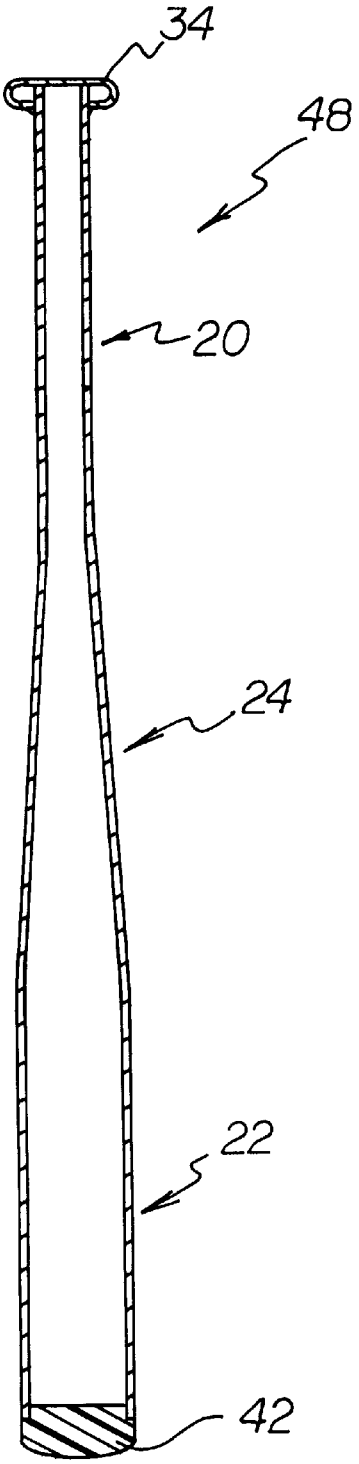
FIG. 3 is a sectional view taken along line 3—3 of FIG. 2.
Figure 4:
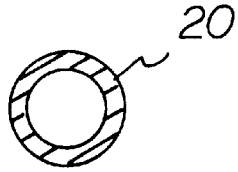
FIG. 4 is a sectional view taken along line 4—4 of FIG. 2.
Figure 5:
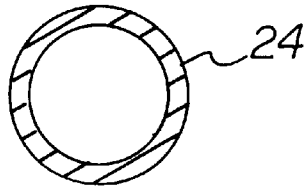
FIG. 5 is a sectional view taken along line 5—5 of FIG. 2.
Figure 6:
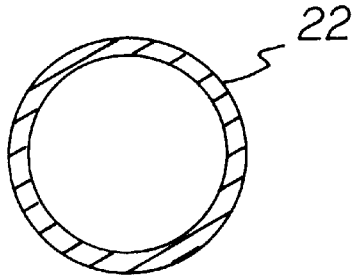
FIG. 6 is a sectional view taken along line 6—6 of FIG. 2.

An alternative embodiment of the end cap is depicted in FIG. 3A. This secondary embodiment employs an injection molded plastic end cap with an internal urethane casting. Such an arrangement provides an end load to the bat. Either of the end cap embodiments can be cast in place, or alternatively, glued in place. Furthermore, the opened second end 38 can be rolled or spun over to enclose the interior of the bat. The transition zone 24 has a first end 44 continuous with the second end 32 of the handle end 20 and a second end 46 which is continuous with the first end 36 of the hitting portion 22. Thus, the handle 20, transition zone 24 and hitting portion 22 are co-extensive with one another.

The increased moment of inertia to weight ratio is achieved by decreasing the overall weight of the bat without changing the moment of inertia. This can be achieved by reducing the wall thickness of the bat in selected areas, which results in a bat that has a more uniform thickness than the bats of the prior art. To compensate for the lighter shell and maintain the same MOI, the end load must be increased. In this manner the weight of the bat is reduced without a corresponding reduction in the moment of inertia. The higher ratio results in faster swing speeds and a higher energy transfer to the ball upon impact.

In aluminum bats 48 the handle end 20, hitting portion 22 and transition zone 24 are each constructed from aluminum. The aluminum bat 48 of the present invention is depicted in FIGS. 1–6. Although aluminum is the preferred embodiment for metal bats, other metals could be utilized such as titanium alloys or high strength steel alloys. The more uniform wall thickness, which characterizes the bat of the present invention, can be achieved through a combination of a swaging process and a secondary forming or machining operation. Specifically, in the swaging process an aluminum cylinder is worked until the transition area 24 and handle 20 are of an appropriate diameter. However, such a process increases the thickness in both the transition 24 and handle areas 20.

In other words, when a bat is fabricated from a hollow tube of metal with a common diameter and thickness throughout, the conventional swaging process acts generally radially and will reduce the overall thickness in areas where the exterior diameter is reduced. As a result, the head of the bat with its enlarged exterior diameter will have the thinnest wall thickness. The handle with its reduced exterior diameter will have an increased wall thickness. The transition area will have an increasing exterior diameter from the handle to the head with a gradually decreasing wall thickness along the axial length thereof.

Aluminum bats 48 fabricated in accordance with the principles of the present invention provide for a more common wall thickness throughout the length of the bat through a secondary forming operation or via the Alcoa method. The wall thickness in the handle 20 and transition areas 24 will be reduced.

The increase of the wall thickness in the handle and transition area is initially created in the primary, generally radial, swaging operation on the entire bat. The subsequent decrease of the wall thickness in the handle and transition area is effected by a secondary swaging operation on only the handle and the transition area. Such secondary swaging is generally axial and acts only on the handle and transition area. It functions to increase the length of the bat in the handle and transition area to thereby decrease the thickness of the wall in these areas. The change of wall thickness in the handle and transition areas is to such an extent as to reduce all swaged areas to a more common wall thickness throughout the length of the bat. For example, a slow pitch softball bat using Alcoa's C-405 alloy could have a barrel thickness measuring 0.072 inches and the handle thickness measuring between about 0.09 to 0.11 inches.

Furthermore, alternative swaging can be utilized to form a transition area 24 of an appropriate diameter without increasing the wall thickness. Through either method the end result is a handle end 20, hitting portion 22 and transition zone 24 which are defined by a generally uniform wall thickness.

In the preferred embodiment the aluminum bat 48 has a shell weight in the range from 16 to 21 ounces. The preferred final bat weight, with grips, knobs 34 end cap and end loading 42 added, is within the range between 21 to 29 ounces. Furthermore, for softball bats the combined length of the handle end, hitting portion and transition zone is within the range from 29 to 34 inches. The wall thickness and materials are selected such that the overall mass moment of inertia to weight ratio of the finished bat can be greater than 350 oz-in$^2$ with a weight less than 28.5 ounces.

As indicated hereinabove the bat of the present invention can be constructed from a variety of materials or alloys, the preferred materials being either aluminum or an aluminum/composite combination. Note FIG. 7. The aluminum/composite bat is that described in co-pending U.S. application Ser. No. 08/595,535 which is incorporated herein by reference. In constructing an aluminum/composite bat sheets of a composite material are layered over a mandrel. Thus, in constructing the aluminum/composite bat of the present invention there is no need for the swaging and machining processes described hereinabove.

Specifically, sheets of composite material are layered upon a mandrel until the desired wall thickness is achieved. The sheets of composite material are formed from fiberglass or carbon fibers within an epoxy matrix. As described more fully in the co-pending application 08/595,535, the sheets are layered so as to leave a recess within the hitting area. Over this recess a cylindrical aluminum shell is positioned. Thus, the hitting portion in the aluminum/composite bat consists of the aluminum shell positioned over the underlying composite material, while the handle end and transition zone are each constructed from the composite material. The handle and transition areas are significantly lighter than their traditional all-aluminum counterparts.

Again, a lightweight handle, transition area and shell enables a finished bat to be produced with a higher moment of inertia to weight ratio. In the preferred embodiment, the resulting aluminum/composite bat has a shell weight in the range from 18 to 21 ounces. The preferred final bat weight, with grips, knobs and end loads added, is within the range between 23 to 29 ounces. Furthermore, for softball bats the combined length of the handle end, hitting portion and transition zone is within the range from 31 to 34 inches. Additionally, the wall thickness is selected such that the overall mass moment of inertia to weight ratio is greater than 350 in$^2$ and has a weight less than 28.5 ounces.

TABLE 1

| BAT MODEL | BAT MODEL | BARREL MATERIAL | WEIGHT IN oz. | BALANCE POINT IN INCHES | PERIOD IN SECONDS | MOMENT OF INERTIA OZ*IN$^2$ | MOI TO WEIGHT RATIO IN$^2$ |
|---|---|---|---|---|---|---|---|
| EASTON REFLEX | DAN SCHUCK | ALCOA C-405 | 28.3 | 20.3 | 1.52 | 9153 | 323 |
| EASTON REFLEX | DAN SCHUCK | ALCOA C-405 | 30.1 | 20 | 1.5 | 9275 | 308 |
| EASTON | C-CORE-1996 | C-405 | 29.6 | 20.3 | 1.5 | 9326 | 315 |
| EASTON | NATURAL PRO | GRAPHITE ALUMINUM | 37.8 | 19.7 | 1.53 | 11864 | 314 |

TABLE 1-continued

| BAT MODEL | BAT MODEL | BARREL MATERIAL | WEIGHT IN oz. | BALANCE POINT IN INCHES | PERIOD IN SECONDS | MOMENT OF INERTIA OZ*IN$^2$ | MOI TO WEIGHT RATIO IN$^2$ |
|---|---|---|---|---|---|---|---|
| 34"/38 oz. LOUISVILLE | BALANCE ATPS-POWERDOME | ALCOA C-405 | 28.2 | 20.1 | 1.52 | 8974 | 319 |
| LOUISVILLE | ATPS-POWERDOME | ALCOA C-405 | 30.0 | 21.0 | 1.52 | 10150 | 339 |
| LOUISVILLE | ATPS-POWERIZED BOTTLE BAT | ALCOA C-405 | 23.3 | 18.7 | 1.44 | 6020 | 259 |
| COMPOSITE/AL #1 | MOLDED IN END CAP | ALCOA C-405 | 38.5 | 22.6 | 1.5 | 9314 | 365 |
| COMPOSITE/AL #2 | MOLDED IN END CAP/SPECTRA | ALCOA C-405 | 25.1 | 22.5 | 1.48 | 8871 | 353 |

Table 1 lists the specifications of two such aluminum composite bats along with the specifications of other competitive products. Moment of inertia to weight ratio data illustrates the inventive feature of the present invention. Namely, the bats constructed in accordance with the present invention have a moment of inertia to weight ratio that is significantly higher that prior art bats.

TABLE 2

| Bat Name | Actual Weight (Ounces) | Moment of Inertia (oz-in^2) | MOI/Wgt Ratio (In^2) |
|---|---|---|---|
| Prototype #2 | 23.1 | 8105 | 350.8 |
| Prototype #3 | 23.6 | 8520 | 361 |
| Prototype #4 | 24.6 | 9229 | 375.2 |
| Prototype #5 | 25.6 | 9748 | 380.8 |
| Prototype #6 | 26.6 | 10450 | 392.9 |
| Prototype #7 | 27.7 | 11296 | 407.8 |
| Worth Supercell #2 | 30.3 | 11126 | 367.2 |

A review of all known competitive bats has revealed that there is one competitive commercial bat, the Worth Supercell #2, with a MOI/Weight ratio greater than 350. A review of data relating to such commercial bat and prototype bats made in accordance with the present invention shows that as prototype bats increase in weight, the MOI/Wgt ratio increases. Note Table 2. This is expected because the weight of the bat is being increased by casting a urethane end load into the very end of the bat. This end load will have a large increase on the MOI of the bat. Competitive bats can only achieve a MOI/Wgt ratio greater than 350 if the bats weigh more than 28 ounces because their shell weights are significantly higher before end loading.

The higher than normal moment of inertia to weight ratios that were achieved by utilizing the combined composite aluminum type constructions were an unexpected and beneficial result of this invention. The original intent of incorporating an all-composite handle area, an all-composite transition area, and an aluminum barrel area reinforced with composites was to produce a livelier bat by utilizing a thinner-walled aluminum barrel area.

It is well known in the art of bat making that the thinner the metal in the barrel area, the livelier the bat. In an all-metal bat, the designer is always trading off between achieving maximum liveliness by using the thinnest wall possible and achieving maximum durability by having the thickest wall possible. The goal of the hybrid bat was to utilize a thin metal barrel area for maximum liveliness and back it with a thin layer of composites to improve durability. Utilizing composites in the handle and transition areas was also expected to improve performance by increasing the stiffness of these areas and by reducing the shock and vibration felt by hitters.

In the design of the composite handle and transition areas, the original goal was to simply match the approximate thicknesses found in an all-aluminum bat. Because graphite/epoxy and glass/epoxy composite have lower densities, this resulted in handle and transition areas that were lighter than their all-aluminum counterparts. The unassembled bat tube is typically called a shell. To complete a bat, a handle knob, grip, end cap, and end load must be added to the shell. The required end load for an all-aluminum bat is determined by knowing the desired finish weight of the bat and subtracting the weight of all the other components.

The moment of inertia (MOI) of a bat is a technical way to quantify the swing weight of a bat or how heavy the bat will feel in a player's hands. If a bat were sectioned into an infinite amount of small pieces and each piece was weighed and the distance to each piece to the pivot point of the bat recorded, the MOI of the bat could be represented by the sum of all the weights of each piece times the distance to the pivot point squared. Thus, by changing the distribution of the weight in two bats weighing 28 ounces, the feel and MOI's of these two bats can be dramatically effected. The player notices the difference in that he or she would perceive the bat with the higher MOI to be heavy or harder to swing than the bat with the lower MOI.

When the same subtraction of the component weights from the desired total weight strategy for determining the required amount of end load was used for the composite aluminum bat, the amount of end load was significantly increased due to the lighter weight of this type of bat's shell. When a player tried to swing a bat with this increased end load, the perception was that the bat was much heavier than its actual weight. This perception is because a higher proportion of the weight of the bat is now located further from the player's hands, thus increasing the bat's MOI and perceived swing weight.

What was clearly needed for composite aluminum bats was a new method and strategy for giving the players the feel and swing weight they desired. In traditional slow pitch, all-aluminum softball bats are usually identified and sold by weights. Manufacturers normally will offer bats in increments of an ounce ranging from 26 to 32 ounces. Thus a manufacturer will offer 26, 27, 28, 29, 30 and 32 ounce versions of a particular model of a bat.

In order to give players the desired swing weight, the MOI was measured of all aluminum bats produced. An MOI value was then established that would result in a corresponding feel of the different weight bats. Table 3 below illustrates levels that were determined would give the equivalent swing weight or feel of the standard bats. Note that the corresponding actual weights are significantly below the actual weight of a standard all-aluminum bat. The actual finished weights were determined by end loading the bat with enough weight to give the bat the correct MOI and then just measuring the weight of the bat.

TABLE 3

| Swing Weight | 26 oz | 27 oz | 28 oz | 29 oz | 30 oz | 32 oz |
|---|---|---|---|---|---|---|
| MOI (oz-in$^2$) | 7,850-8,150 | 8,550-8,850 | 9,400-9,559 | 9,850-10,150 | 10,450-10,750 | 11,150-11,450 |
| Actual Weight (oz) | 22.4-23.8 | 23.4-24.9 | 24.5-25.9 | 25.4-26.8 | 26.3-27.7 | 27.5-28.9 |

Two example bats that show actual weights, MOI values, and other physical properties of bats are shown in Table 4.

TABLE 4

| Bat Model | Bat Model | Bat Materials | Wgt (oz) | Balance Point (in to end) | Period (secs) | Center of Percussion (inches) | MOI (oz-in-sec^2) | MOI/WGT Ratio (in-sec^2) |
|---|---|---|---|---|---|---|---|---|
| Prototype #6 | Finished Bat | Alcoa C-405 barrel & composite | 25.7 | 22.9 | 1.54 | 21.06 | 10092 | 392 |
| Louisville | Powerdome | Alcoa C-405 | 30.0 | 21.0 | 1.52 | 20.86 | 10150 | 339 |

In a collision between a bat and a ball, many factors influence the subsequent reaction: The hardness and liveliness of the ball; the materials and thicknesses used to produce the bat; the speed at which the bat is swung; and the distribution of the weight within the bat (the MOI). For a given MOI, the player wants to maximize the speed at which he can swing the bat.

The swinging of a bat involves both translation and rotation components. The rotational velocity is a function of the force applied and the MOI of the bat (Force=Inertia× angular acceleration). The translation velocity is a function of the force applied and the weight of the bat (Force=mass× acceleration). Looking at the two bat examples shown above, the bats have very similar MOI values, but the composite aluminum bat is much lighter and therefore has a higher MOI/weight ratio.

Assuming the player applies the same energy or force to his swing, the rotational portion of the swing velocities will be the same, but because prototype #6 is lighter, the translational velocity will be higher. As a result, the combined velocity or the actual speed of the bat at the impact location with the ball will be higher. In conclusion, given two bats with the same MOI, the player will be able to swing the bat with the higher MOI/weight ratio faster, and therefore hit the ball further.

To confirm these theories, players swung bats with similar MOI values and different weights and the speed of the ball coming off the bat after impact was measured. As can be seen in Table 5, players were able to swing the composite aluminum bats faster and ball speeds coming off the bat increased.

TABLE 5

| Category | Easton Redline 30-1 | Louisville Springsteel 30-4 | DeMarini Doublewall 30 | Fusion 29-4 | Stainless 465-1 29 |
|---|---|---|---|---|---|
| Bat Weight | 29.9 | 29.8 | 30 | 23.8 | 26 |
| MOI | 9559 | 10559 | 10638 | 9920 | 10473 |
| MOI/Wgt | 319.7 | 354.3 | 354.6 | 416.8 | 402.8 |
| Ball Speed (MPH) | 80.2 | 80.1 | 86.2 | 87.8 | 87.7 |

The phenomena of minimizing the weight in the handle and maximizing the weight in the impact location is found in related sports equipment. For example, the ideal golf club would be one in which the shaft weighed nothing and all the weight was concentrated in the head of the club. Thus, the trend has been for golf shafts to become increasingly lighter. The trend in tennis rackets has also been similar. The overall weight of the rackets has become lighter, while MOI values of the rackets have only decreased a little.

Therefore, what is disclosed and claimed herein is a method of fabricating a softball bat with a handle, a barrel and an intermediate zone. The method of fabrication includes providing at least one interior layer of a composite material extending the full length of the bat; providing at least one additional layer of a composite material in the barrel area; providing a plurality of plies of composite material of varying lengths for the entire handle and various portions of the intermediate zone; providing a plurality of plies of composite material of varying lengths for the entire handle and entire intermediate zone and portions of the barrel; positioning an exterior-most ply of an adhesive material over the composites in the barrel area; adhering a metal tube over the exterior of the barrel, the tube having a thickness of between about 0.025 and 0.070 inches; and molding the plies and metal tube together whereby the lightweight shell is finished and end loaded to create a moment of inertia to weight ratio of between about 370 and 420 oz-in$^2$ and an overall weight less than 28.5 ounces.

Further, the metal tube utilized in the method of fabrication is preferably made from high strength stainless steel, preferably Carpenter Specialty Alloy Custom 465, with a wall thickness between about 0.020 and 0.040 inches. The barrel of the bat constructed utilizing the method as described hereinabove may, in the alternative, be made from aluminum with a wall thickness of between about 0.040 and 0.070 inches. Lastly, the bat further includes a cap over the free end of the barrel and a cap over the free end of the handle.

The method may also be considered as a method of fabricating a softball bat shell. In this method, there is provided a hollow handle end of an enlarged thickness of composite material having an opened first end, a second end and an intermediate region therebetween is provided. Also provided is a hollow hitting end of a reduced thickness of composite material having a first end, an opened second end and an intermediate region therebetween. A hollow frustoconical transition zone of a composite material with an increasing diameter along its length having a first end continuous with the second end of the handle end and a second end continuous with the fist end of the hitting end is next provided. A metal tubular barrel is then positioned over the hitting end. Lastly, the handle end, hitting portion, transition zone and barrel are molded to thereby define a wall having a thickness of between about 0.090 and 0.12 inches in the handle end, a composite thickness of between about 0.015 and 0.045 inches in the hitting end, a total barrel thickness of about 0.030 to 0.095 inches, with the overall bat shell weight being within the range of 16 to 21 ounces and a length of about 34 inches.

Figure 7:
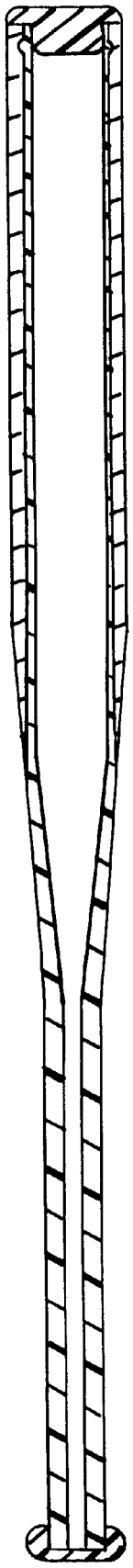
FIG. 7 is a cross-sectional view taken centrally through a composite bat constructed in accordance with the present invention.
Figure 9:
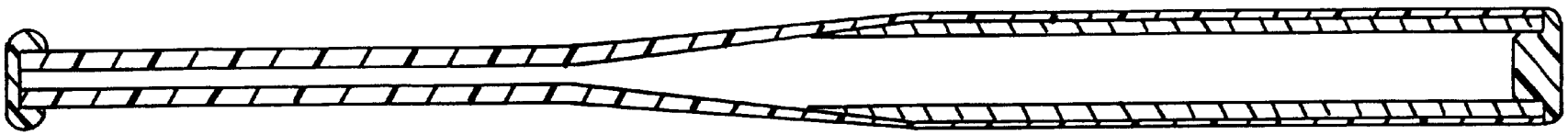
FIG. 9 is a cross-sectional view similar to FIG. 7 but with the metal on the interior.

The metal barrel includes an annular recess adapted to receive an annular projection to abate axial shifting between the composite material and the barrel. Further, the end of the barrel adjacent to the intermediate transition zone is tapered as it enters into the intermediate transition zone. Lastly, as shown in FIG. 9, the metal tubular barrel may be located interior of the composite material rather than exterior thereof as shown in FIG. 7.

Further, in the method described above, the molding is preferably performed through the application of heat and pressure to the composite material with the tubular metal insert over the hitting end and with an adhesive therebetween.

The softball bat created by the methods described above comprise, in combination, a handle end having an opened first end, a second end and an intermediate extent therebetween; a knob secured to the first end of the handle; a hitting portion having a first end, an opened second end and an intermediate extent therebetween; an end closure for the opened second end of the hitting portion; a transition zone having a first end continuous with the second end of the handle end and a second end continuous with the first end of the hitting portion; the handle end, hitting portion and transition zone each being defined by a continuous wall throughout; and the wall thicknesses being selected such that a finished bat with an overall mass moment of inertia to weight ratio greater than 350 oz-in$^2$ and a weight less than 28.5 ounces can be produced.

Further, the bat as set forth above is preferably constructed wherein the moment of inertia to weight ratio is between about 370 and 410 oz-in$^2$.

Figure 8:
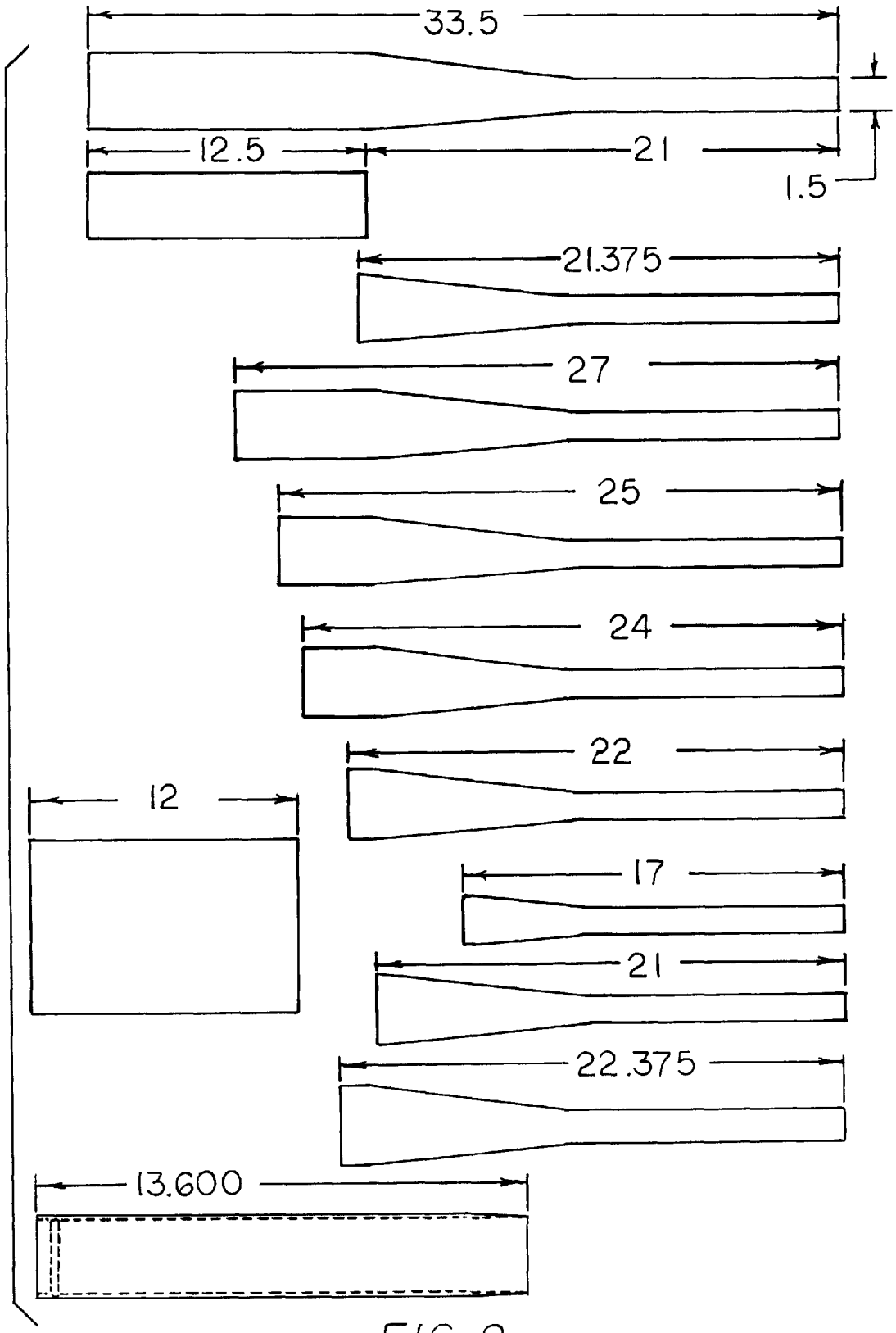
FIG. 8 is a schematic illustration of the ply layers used in fabricating the bat of FIG. 7.

In the preferred embodiment of the invention, ten composite plies are utilized. In addition, one ply of adhesive and one ply of metal are also utilized. The lengths of these plies in inches can be seen in FIG. 8. All composite plies utilize a 250° F. curing epoxy resin system. The first ply on the inside of the bat is shown at the top of FIG. 8 with a length of 33.5 inches and the fibers of glass cloth at +/−45 degrees. The next ply is for the barrel, or hitting, area of the bat only. This is of unidirectional glass at 183 gsm (grams per square meter) at 0 degree plies. Plies where the fibers are oriented along the length of the bat are said to be at a zero degree orientation. The next seven plies are of graphite 300 at 0 degrees with the tenth composite ply being Hexcel Style 282 style graphite weave at +/−45 degrees. Each of these ten plies are dual members with an upper and lower ply on the mandrel. The next ply is an adhesive, preferably of Cyanimid FM73, 006 psf. The last layer is metal over the adhesive in the barrel, or hitting, area of the bat and extending slightly into the transition zone. The outer diameter of the metal barrel is 2.25 inches and designed to fit within a clam shell style forming mold. The aluminum tube is prepared through an alkaline degrease followed by a chromate conversion coating, followed by a rinse and followed by a primer with Cytec BR-127 primer per Mil-C-5541 for improved adhesion.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

What is claimed is:

1. A method of fabricating a softball bat with a handle, a barrel and an intermediate zone comprising, in combination:

providing at least one interior layer of a composite material extending the full length of the bat;

providing at least one additional layer of a composite material in the barrel area;

providing a plurality of plies of composite material of varying lengths for the entire handle and various portions of the intermediate zone;

providing a plurality of plies of composite material of varying lengths for the entire handle and entire intermediate zone and portions of the barrel;

positioning an exterior-most ply of an adhesive material over the composites in the barrel area to thereby form an inside surface and an outside surface of the composite structure in the barrel area;

adhering a metal tube onto one surface of the barrel area, the tube having a thickness of between about 0.025 and 0.070 inches; and molding the plies and metal tube together whereby the lightweight shell is finished and end loaded to create a moment of inertia to weight ratio of between about 370 and 420 oz-in$^2$ and an overall weight less than 28.5 ounces.

2. The method as described in claim 1 wherein the metal tube is positioned on the inside surface of the composite structure in the barrel area.

3. The method as disclosed in claim 1 wherein the metal tube is made from high strength stainless steel, preferably Carpenter Specialty Alloy Custom 465, with a wall thickness between about 0.020 and 0.040 inches.

4. The method as disclosed in claim 1 wherein the metal tube is made from aluminum with a wall thickness of between about 0.040 and 0.070 inches.

5. The method as set forth in claim 1 and further including a cap over the end of the barrel area remote from the handle and a cap over the end of the handle remote from the barrel area.

6. A method of fabricating a softball bat shell comprising:

providing a hollow handle end of an enlarged thickness of composite material having an opened first end, a second end and an intermediate region therebetween;

providing a hollow hitting end of a reduced thickness of composite material forming an inside surface and an outside surface and having a first end, an opened second end and an intermediate region therebetween;

providing a hollow frusto-conical transition zone of a composite material with an increasing diameter along its length having a first end continuous with the second end of the handle end and a second end continuous with the first end of the hitting end;

positioning a metal tubular barrel in contact with one surface of the composite material in the hitting end; and molding the handle end, hitting portion, transition zone and barrel to thereby define a wall having a thickness of between about 0.090 and 0.12 inches in the handle end, a composite thickness of between about 0.015 and 0.045 inches in the hitting end, a total barrel thickness including the composite material and barrel being between about 0.030 and 0.095 inches, with the overall bat shell weight being within the range of 16 to 21 ounces and a length of about 34 inches.

7. The method as set forth in claim 6 wherein the molding is effected through the application of heat and pressure to the composite material with the tubular metal insert over the hitting end and with an adhesive therebetween.

* * * * *